US005946888A

United States Patent [19]

Foster et al.

[11] Patent Number: 5,946,888

[45] Date of Patent: Sep. 7, 1999

[54] METHOD AND APPARATUS FOR AUTOMATIC PACKAGING OF CHEESE

[75] Inventors: J. Danny Foster, Inman; Gregory McDonald, Simpsonville; Jeff Walker, Easley, all of S.C.

[73] Assignee: Cryovac, Inc., Duncan, S.C.

[21] Appl. No.: 09/062,963

[22] Filed: Apr. 20, 1998

[51] Int. Cl.[6] ..... B65B 43/26

[52] U.S. Cl. ..... 53/459; 53/570; 53/572

[58] Field of Search ..... 53/459, 572, 570, 53/571

[56] References Cited

U.S. PATENT DOCUMENTS

| | | | |
|---|---|---|---|
| 3,217,464 | 11/1965 | Feingold | 53/187 |
| 3,504,784 | 4/1970 | Noyes et al. | 198/170 |
| 3,527,337 | 9/1970 | Formo | 198/170 |
| 3,935,691 | 2/1976 | Broch | 53/59 |
| 4,175,656 | 11/1979 | Lang | 198/748 |
| 4,202,153 | 5/1980 | Lerner et al. | 53/459 |
| 4,464,882 | 8/1984 | Van Ginkel et al. | 53/530 |
| 4,564,105 | 1/1986 | Brouwer et al. | 198/457 |
| 5,251,422 | 10/1993 | Goodman et al. | 53/251 |
| 5,342,461 | 8/1994 | Murphy | 156/64 |
| 5,402,625 | 4/1995 | Halstead | 53/570 |
| 5,421,783 | 6/1995 | Kockelman et al. | 472/131 |
| 5,473,869 | 12/1995 | Chikatani | 53/570 |

*Primary Examiner*—John Sipos

[57] ABSTRACT

A method of packaging a block product includes providing an opened tubular bag having a bag mouth, and a bag bottom; positioning the bag for loading; provided a block product; positioning the block product on a product platform; engaging the trailing edge of the block product with a protrusion, said protrusion mounted on a conveyor belt; and advancing the conveyor belt, with the protrusion mounted thereon, thereby advancing the block product toward the mouth of the bag, such that the momentum of the block product forces the block product to enter the bag and strike the bag bottom, and such that the protrusion mounted on the conveyor disengages from the trailing edge of the block product before the block product strikes the bag bottom. An apparatus is also disclosed.

4 Claims, 4 Drawing Sheets

METHOD AND APPARATUS FOR AUTOMATIC PACKAGING OF CHEESE

FIELD OF THE INVENTION

The present invention relates to a method and apparatus for automatic packaging of block products, especially food products such as block cheese and ham.

BACKGROUND OF THE INVENTION

Many packaging applications, especially food packaging, require or benefit from the use of bags made from various thermoplastic materials and structures. Examples of commercial bags include heat shrinkable bags supplied by Cryovac, Inc.

These bags are commonly used in large-scale cheese packaging systems where production speed and efficiency are important.

At the loading station of a conventional system, each bag is opened, and an article such as a 3 to 11 lb. block of Italian cheese or other food product is pushed through a set of product guides and into the bag. The pushing operation can be done manually, or mechanically. Mechanical pushers typically operate in a reciprocal motion.

One inherent problem in this arrangement is that the presence of the pusher in the area of the product guides, and sometimes within the bag opening during part of the loading cycle, interferes with the staging of subsequent product. The pusher must be retracted in a reciprocal motion before the next product unit can be advanced to the next bag. This slows the bag loading operation.

It is desirable to provide a method and apparatus which avoids this problem.

SUMMARY OF THE INVENTION

In one aspect, a method of packaging a block product comprises providing an opened tubular bag having a bag mouth, and a bag bottom; positioning the bag for loading; provided a block product; positioning the block product on a product platform; engaging the trailing edge of the block product with a protrusion, said protrusion mounted on a conveyor belt; and advancing the conveyor belt, with the protrusion mounted thereon, thereby advancing the block product toward the mouth of the bag, such that the momentum of the block product forces the block product to enter the bag and strike the bag bottom, and such that the protrusion mounted on the conveyor disengages from the trailing edge of the block product before the block product strikes the bag bottom.

In a second aspect, an apparatus for packaging a block product in a bag comprises a product guide for opening and positioning a bag, the bag having a bag mouth and a bag bottom; a conveyor belt, the belt having a pair of belt end rollers; a protrusion mounted to the conveyor belt, the protrusion adapted to engage a trailing edge of the block product; a product platform for positioning the block product, the platform positioned above the conveyor belt, and having a notched recess adapted to accommodate the protrusion as it travels past the platform; and means for providing intermittent motion of the conveyor belt and protrusion, such that the momentum of the block product forces the block product to enter the bag and strike the bag bottom, and such that the protrusion mounted on the conveyor belt disengages from the trailing edge of the block product before the block product strikes the bag bottom.

DESCRIPTION OF THE PREFERRED EMBODIMENTS

The invention is described with reference to FIGS. 1 to 4.

Figure 1:
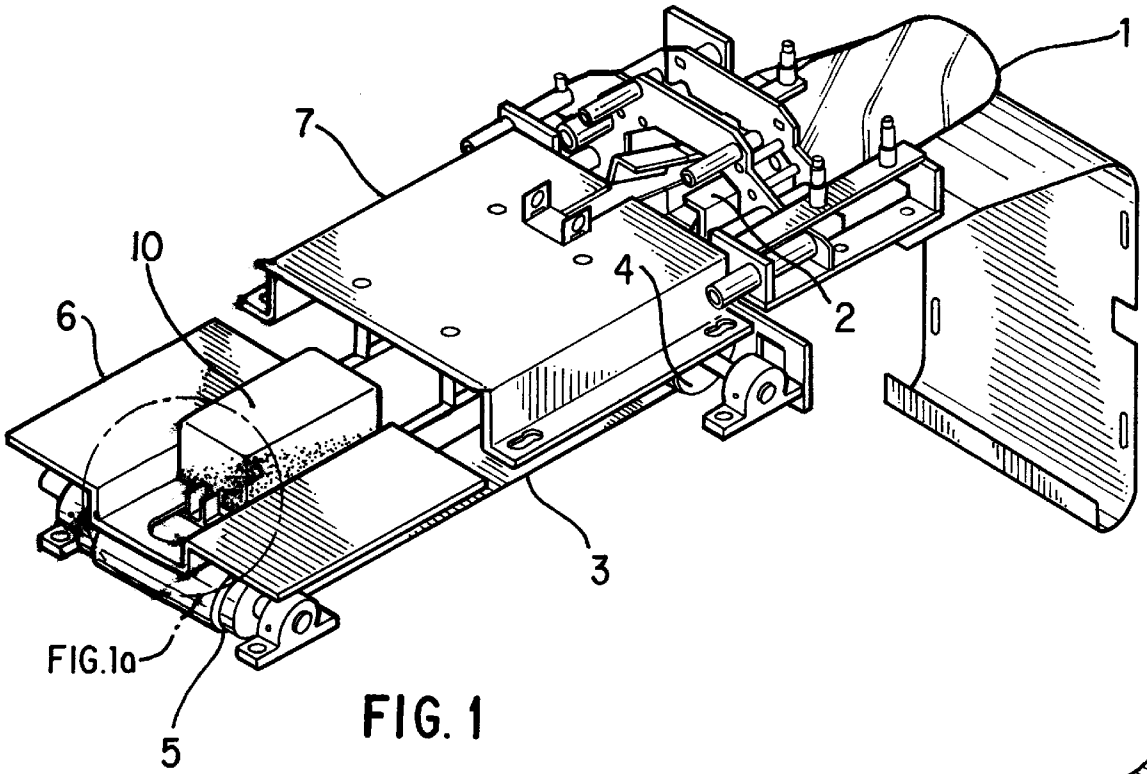
FIG. 1 is a perspective view of the apparatus of the invention.
Figure 1A:
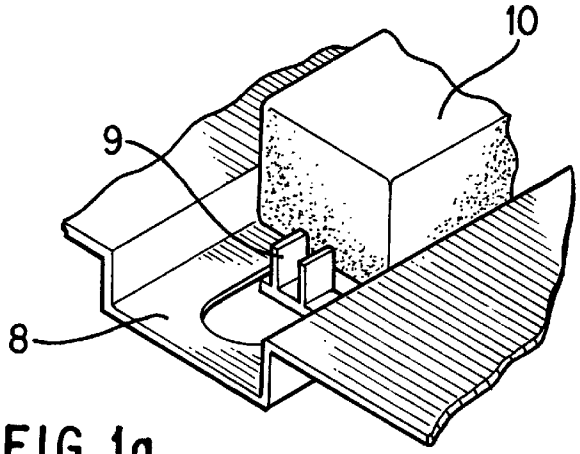
FIG. 1*a* is a blown-up perspective view of a portion of the apparatus of FIG. 1.

FIG. 1 shows a bag [1] which is opened and positioned for loading by product guide assembly [2]; a conveyor belt [3] with suitable controls for intermittent or continuous motion [not shown]; conveyor end rollers [4] and [5]; product staging platform [6]; and product guide [7]. The product staging platform [6] has a notched relief or recess [8]. This notched recess allows for the cyclic passage of protrusion [9] as it passes platform [6] on each loading cycle.

Product [10], which is e.g. a 3 to 11 lb. block of Italian cheese (although it can be another food or non-food product) is positioned on the product staging platform [6] as shown in FIG. 1, with clearance between the protrusion [9] and the trailing edge of the product [10]. The product [10] can be placed on platform [9] by any suitable means. Preferably, an in-line conveyor [not shown for sake of clarity], disposed at a slightly higher elevation than conveyor belt [3], advances a plurality of products [10] one at a time toward platform [9]. Each unit can drop from such a feed conveyor onto the platform at timed intervals corresponding with the speed of the conveyor belt [3]. Suitable logic controllers can be used to synchronize the delivery of product to the bagging operation. Alternatively, of course, each product [10] can be manually placed on platform [9] at appropriate intervals.

"Block product" herein refers to any product having a geometry, composition, and size which allows it to be advanced as described herein and propelled, by the momentum of the product, into a thermoplastic bag, without any substantial damage to the product. Blocks of cheese are the preferred product. Other products include ham, and non-food products. The product geometry can be of any suitable shape, e.g. a prism such as a square prism (e.g. a cube), a rectangular prism, or a triangular prism; a cylinder; a sphere; an ellipsoid; or even an amorphous shape.

Figure 2:
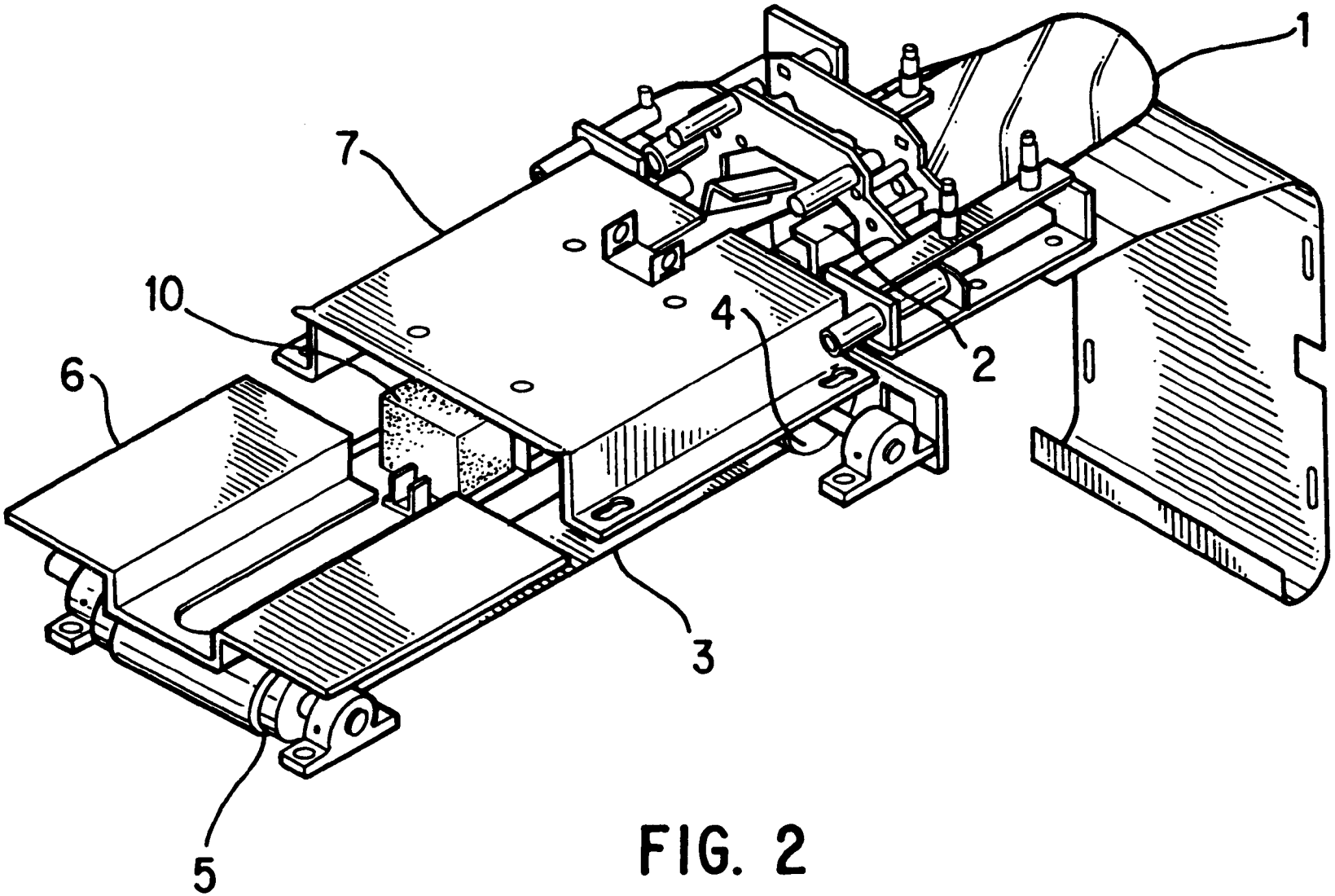
FIG. 2 is a perspective view of the apparatus of the invention shown with the block food product advanced from its position in FIG. 1.

From the home position shown in FIG. 1, loading the block product into bag [1] is accomplished by advancing the conveyor belt [3] causing the protrusion [9] to engage the trailing edge of the product [10], and moving the product underneath the product guide [7] and towards the product guide assembly [2] as shown in FIG. 2.

Figure 3:
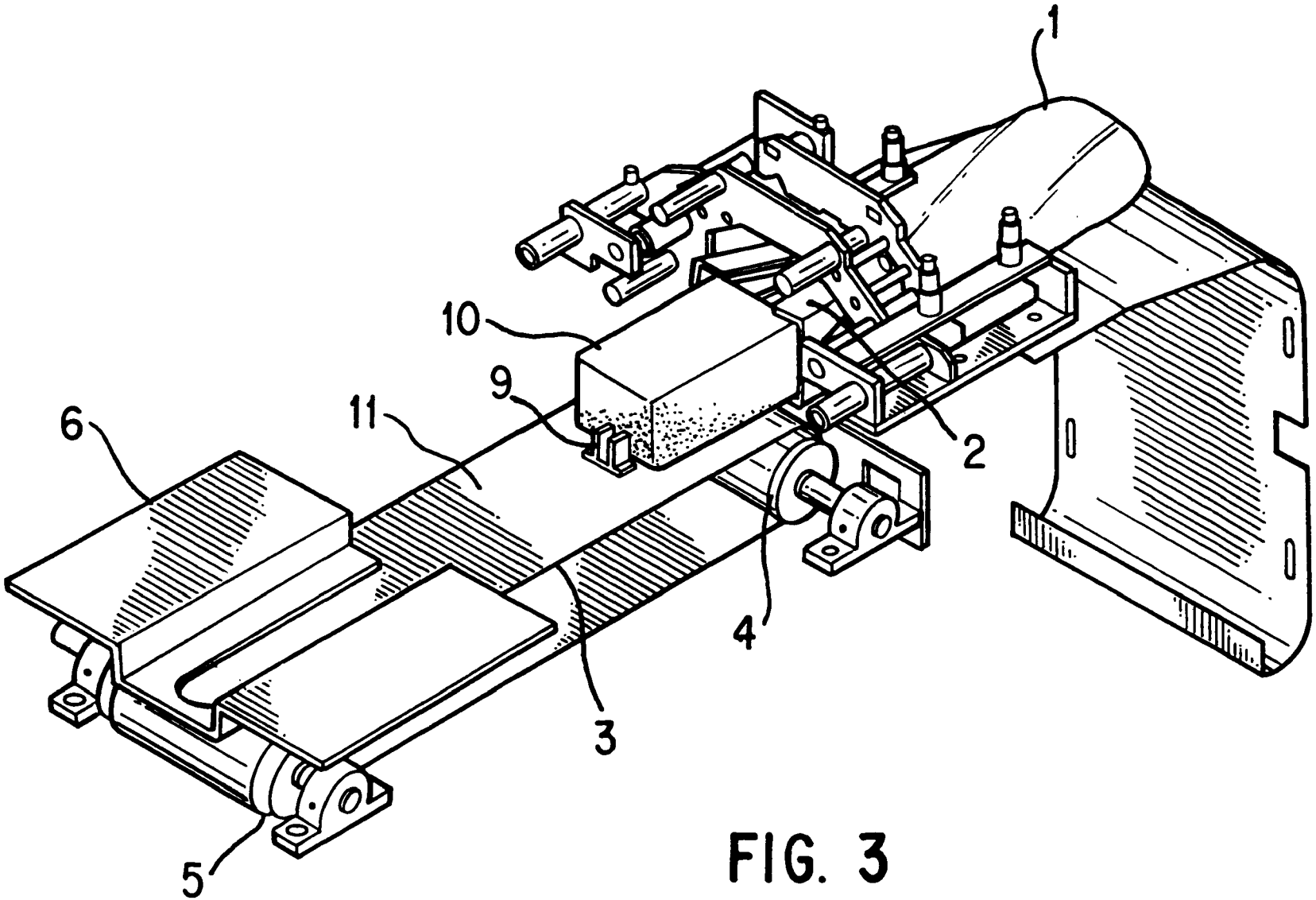
FIG. 3 is a perspective view of the apparatus of the invention shown with the block food product advanced from its position in FIG. 2.

With continuing advancement of the conveyor belt [3], the block product [10] engages the product guide assembly [2] as shown in FIG. 3. Note that product guide [7] is not shown in FIG. 3 for the sake of clarity.

As the protrusion travels with the belt around end roller [4], contact of protrusion [9] with the trailing edge of block product [10] is terminated as momentum thrusts the block product through the product guide assembly [2] and into the bag [1]. As the block product strikes the bottom of the bag

Figure 4:
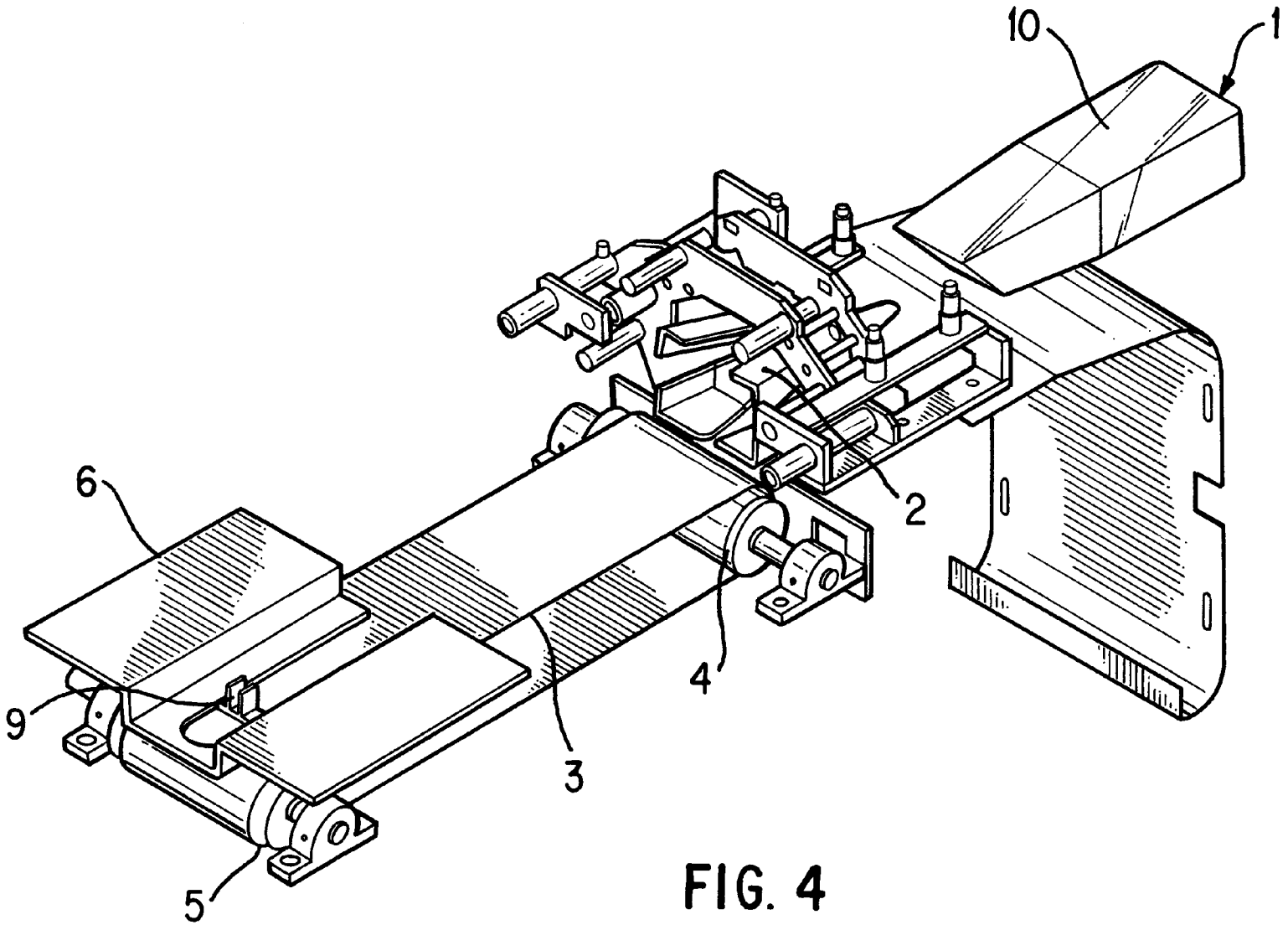
FIG. 4 is a perspective view of the apparatus of the invention shown with the block food product advanced from its position in FIG. 3.

[1], the momentum of the block product pulls the bag [1] off the product guide assembly [2], also shown in FIG. 4. At the same time, the motion of conveyor belt [3] continues, bringing the protrusion [9] to its home position shown in FIG. 4, ready to repeat the advancing/loading cycle with another product unit.

The bag [1] is typically a side seal or end seal bag.

Bags of the present invention are preferably made from tubing. It is also possible to use this invention with other embodiments, such as two discrete film panels which are of substantially the same size, and brought together and sealed along two edges and the bottom to form a bag.

Other components typical of a bag loading system can be used with benefit in connection with the present invention. These are well known and conventional and need no further description for those skilled in the art. For example, electromechanical means for opening and positioning each bag, for intermittently or continuously advancing the conveyor belt, and the like are conventional and within the purview of the skilled artisan. Process controller logic can be conventionally used.

The invention offers a distinct advantage. The momentum of the product is used to carry the product through the product guides and to the bottom of the bag. Because the conveyor belt [3] and associated protrusion [9] travel in a cyclic intermittent or continuous path, they do not interfere with the staging of subsequent product. Thus, the product staging platform allows subsequent product to be positioned on the platform while the belt is in motion, thus increasing the productivity of the machine.

Utilizing product momentum to bag the product eliminates the need for the direct force of a pusher. In the prior art, the product is either manually loaded into a bag, or a pusher is activated which must pass through product guides, and into the bag, and then withdrawn from the bag interior and the product guides, before another product unit can be loaded.

It is to be understood that variations of the present invention can be made without departing from the scope of the invention, which is not limited to the specific embodiments and examples disclosed herein, but extends to the claims presented below.

For example, although the product staging platform [6] is shown as extended above and parallel to a portion only of the conveyor belt [3], the platform can be of any suitable length, and specifically can extend from one end of the belt to the product guide assembly. In this embodiment, the block product, although still engageable by the protrusion of conveyor belt [3], does not come into contact with the belt itself. This avoids the buildup of debris from product [10] that can potentially build up on the upper surface [11] of the belt over time.

Any films, especially thermoplastic films such as olefinic films with or without oxygen barrier functionality, can be used with benefit in this invention. These films are made by extrusion coating, coextrusion, lamination, or other suitable processes. Bags are preferably heat shrinkable, but can be non-shrinkable, and preferably at least partially crosslinked. Preferred films are multilayer in construction.

The structural components of the apparatus can be made from any suitable conventional materials.

What is claimed is:

1. A method of packaging a block product comprising:

a) providing an opened tubular bag comprising:
   i) a bag mouth, and
   ii) a bag bottom;

b) positioning the bag for loading;

c) providing a block product;

d) positioning the block product on a product platform;

e) engaging the trailing edge of the block product with a protrusion, said protrusion mounted on a conveyor belt;

f) supporting the block product on the conveyor belt;

g) advancing the conveyor belt, with the protrusion mounted thereon, and the block product supported thereon, thereby advancing the block product toward the mouth of the bag, such that the momentum of the block product forces the block product to enter the bag and strike the bag bottom, and such that the protrusion mounted on the conveyor disengages from the trailing edge of the block product before the block product strikes the bag bottom.

2. The method of claim 1 further comprising, between steps (d) and e), the step of passing the protrusion mounted on the conveyor belt through a notched recess of the product platform.

3. An apparatus for packaging a block product in a bag comprising:

a) a product guide for opening and positioning a bag, the bag having a bag mouth and a bag bottom;

b) a conveyor belt, the belt having a pair of belt end rollers, the belt adapted to support and convey the block product;

c) a protrusion mounted to the conveyor belt, the protrusion adapted to engage a trailing edge of the block product;

d) a product platform for positioning the block product, the platform positioned above the conveyor belt; and e) means for providing intermittent motion of the conveyor belt and protrusion, such that the momentum of the block product forces the block product to enter the bag and strike the bag bottom, and such that the protrusion mounted on the conveyor belt disengages from the trailing edge of the block product before the block product strikes the bag bottom.

4. The apparatus of claim 3 further comprising a notched recess in the product platform, said recess adapted to accommodate the protrusion as it travels past the platform.

* * * * *

UNITED STATES PATENT AND TRADEMARK OFFICE

CERTIFICATE OF CORRECTION

PATENT NO. : 5,946,888

DATED : September 7, 1999

INVENTOR(S) : J. Danny Foster, Gregory McDonald and Jeff Walker

It is certified that error appears in the above-identified patent and that said Letters Patent is hereby corrected as shown below:

In claim 1, paragraph (e), delete "engaging the trailing edge of the block product with a protrusion, said protrusion mounted on a conveyor belt;" and substitute therefor -- providing a conveyor belt below said platform, the conveyor belt having a protrusion mounted thereon;---

In claim 1, paragraph (f), delete "supporting the block product on the conveyor belt;" and substitute therefor --advancing the block product from said platform onto said conveyor belt so that said belt supports said block product;--

In claim 1, paragraph (g), line 3, before the word "thereby", insert --the trailing edge of the block product engaged by the protrusion--.

In claim 2, lines 1 and 2, delete ", between steps (d) and (e),"

In claim 3, paragraph (e), line 2, delete "," and substitute therefor ---to advance the block product from the platform onto the conveyor belt and--.

Signed and Sealed this

Thirtieth Day of May, 2000

*Attest:*

Q. TODD DICKINSON

*Attesting Officer*

*Director of Patents and Trademarks*